US007275347B2

(12) United States Patent
Hayes

(10) Patent No.: US 7,275,347 B2
(45) Date of Patent: Oct. 2, 2007

(54) POST-TENSION ANCHOR SEAL CAP

(75) Inventor: Norris Hayes, Sugar Land, TX (US)

(73) Assignee: Hayes Interests, Inc., Sugar Land, TX (US)

( * ) Notice: Subject to any disclaimer, the term of this patent is extended or adjusted under 35 U.S.C. 154(b) by 141 days.

(21) Appl. No.: 11/203,355

(22) Filed: Aug. 12, 2005

(65) Prior Publication Data

US 2005/0284050 A1 Dec. 29, 2005

Related U.S. Application Data

(62) Division of application No. 10/357,128, filed on Feb. 3, 2003, now abandoned.

(51) Int. Cl.
*E04C 5/08* (2006.01)

(52) U.S. Cl. ..... 52/223.13; 52/223.6; 52/223.14; 403/374.1; 403/371; 24/122.6; 24/459

(58) Field of Classification Search ..... 52/223.13, 52/223.14, 223.6; 24/122.6, 459; 403/374.1, 403/371

See application file for complete search history.

(56) References Cited

U.S. PATENT DOCUMENTS 3,820,832 A * 6/1974 Brandestini ..... 24/115 A
4,343,122 A * 8/1982 Wlodkowski et al. ... 52/223.13
4,719,658 A * 1/1988 Kriofske ..... 52/223.13
4,773,198 A * 9/1988 Reinhardt ..... 52/223.13
5,018,251 A * 5/1991 Brown ..... 24/122.6
5,594,977 A * 1/1997 McCallion ..... 24/136 B
5,749,185 A * 5/1998 Sorkin ..... 52/223.13
5,755,065 A * 5/1998 Sorkin ..... 52/223.13
6,023,894 A * 2/2000 Sorkin ..... 52/223.8
6,817,148 B1 * 11/2004 Sorkin ..... 52/223.13
6,883,280 B2 * 4/2005 Hayes ..... 52/223.13
7,174,685 B2 * 2/2007 Hayes ..... 52/223.6

* cited by examiner

*Primary Examiner*—Laurie K. Cranmer
(74) *Attorney, Agent, or Firm*—Richard A. Fagin; Alan J. Atkinson

(57) ABSTRACT

An anchor for engagement with a post-tension tendon includes an anchor base having a generally tapered wedge receiving bore. A sheath surrounds the anchor base. The sheath has a substantially cylindrical extension on one side of the anchor base for contacting the tendon at a distal end thereof from the anchor base. The extension is formed integrally with the sheath and has a seal disposed therein proximate the distal end. A cap having external threads thereon is for engaging corresponding internal mating threads on the sheath on a side of the anchor base opposite to the sheath extension. The cap has a tool engagement surface thereon to facilitate rotation by a tool for engagement with the sheath.

14 Claims, 4 Drawing Sheets

POST-TENSION ANCHOR SEAL CAP

CROSS REFERENCE TO RELATED APPLICATIONS

This is a divisional of application Ser. No. 10/357,128 filed on Feb. 3, 2003 now abandoned.

BACKGROUND OF INVENTION

1. Field of the Invention

The invention relates to the field of post tension systems for strengthening concrete. More particularly, the invention relates to an improved anchor and method for reducing corrosion on the wire strands of a post-tension tendon.

2. Background Art

Mono-strand tendons typically comprise a seven wire strand cable or tendon placed within a plastic or elastomeric sheath. A seven wire tendon is formed with six wires helically wrapped around a central core wire.

Wire cable corrosion is a significant concern in post tension systems. Such corrosion occurs when water, salt and other corrosive agents contact the metallic tendon materials. Tendon failure typically occurs due to water intrusion into the interstices between the tendon and is typically concentrated at tendon ends or anchors.

Such failure also occurs at portions of the tendon damaged segments caused during installation. The installation of tendons typically occurs in a rugged construction environment where the tendons can be damaged by equipment, careless handling and contact with various site hazards. When the elastomeric sheath is punctured, a water leak path contacting the wire tendon is established. The puncture must be patched to resist water intrusion between the sheath and tendon. The puncture and patch can create a discontinuity between the tendon and the sheath, and this discontinuity can impede proper installation and performance of the tendon.

One conventional technique for providing extra protection in the corrosive environments is to increase the thickness of the plastic sheath covering the tendon. A plastic sheath at least forty mils thick can be formed around the tendon resist abrasion and puncture damage. Although this approach provides incremental protection against leakage, a thicker sheath does not provide redundant protection to the tendon steel.

Another technique for providing extra protection in corrosive environments uses seals and grease-filled pockets for blocking water intrusion into the central tendon core. Oil or grease is pumped into the exposed tendon end to fill the interstices at the tendon ends, however this procedure does not protect the internal wire strands forming the tendon.

Another technique for resisting high corrosion environments is to specially coat or otherwise treat the individual wire strand with an electrostatic fusion-bonded epoxy to a thickness between one and five mils thick. Similar wire coating techniques use galvanized wire and other corrosion resistant wires within the multiple wire cables to form a corrosion resistant tendon. Significant effort has been made to create improved corrosion resistant materials compatible with the exterior sheaths and resistant to corrosion. Corrosion resistant materials typically have an affinity to metal and are capable of displacing air and water. Additionally, such materials are relatively free from tendon attacking contaminants such as chlorides, sulfides and nitrates. However, such tendons are expensive and the effectiveness of such corrosion resistant materials may not resist corrosion after the tendon is damaged.

Tendon corrosion typically occurs near the post-tension anchors because the outer sheath is removed from the wire tendon at such locations. To protect the bare wire from corrosion, protective tubes are connected to the anchor and are filled with the grease or other corrosion preventative material. This conventional practice is demonstrated by different post-tension systems. For example, U.S. Pat. No. 5,271,199 to Northern (1993) disclosed tubular members and connecting caps for attachment to an anchor. U.S. Pat. No. 5,749,185 to Sorkin (1998) disclosed split tubular members for attachment to and anchor and for installation over the tendon. U.S. Pat. No. 5,897,102 to Sorkin (1999) disclosed a tubular member having a locking surface for improving the connection to an anchor, and a cup member and extension for engagement on the other side of the anchor. U.S. Pat. No. 6,027,278 to Sorkin (2000) and U.S. Pat. No. 6,023,894 to Sorkin (2000) also disclosed a tubular member having a locking surface to improve the connection to an anchor. U.S. Pat. No. 6,098,356 to Sorkin (2000) disclosed attachable tubular members filled with corrosion resistant grease.

A need exists for an improved post-tension seal for preventing fluid intrusion into the inner part of a post-tension anchor. The system should be compatible with existing installation procedures and should resist the risk of water intrusion into contact with internal tendon wires.

SUMMARY OF THE INVENTION

The invention provides an anchor for engagement with a post-tension tendon. The anchor comprises an anchor base having an aperture oriented along a centerline for permitting insertion of the tendon therethrough, wherein the aperture has first and second surfaces each having different shape relative to said aperture centerline, and wherein the first and second surfaces continuously enlarge the size of the aperture from one side of the anchor base to another side of said anchor base. A sheath is engaged with the anchor base and includes a cylindrical extension having a contact end distal from the anchor base for contacting the tendon as the tendon is inserted through the cylindrical extension and the anchor base aperture.

In other embodiments of the invention, the cap includes a cap extension having a hollow interior for permitting passage of the tendon therethrough, and the exterior surface of the cap extension can be engagable with a pocketformer. A lock can retain the pocketformer in detachable engagement with the cap extension.

In another embodiment of the invention, a post-tension anchor system comprises a post-tension tendon having a sheath and inner wire strands, an anchor base having a shaped aperture for permitting insertion of the tendon therethrough, a sheath engaged with the anchor base wherein said sheath includes a cylindrical extension having a contact end distal from the anchor base for contacting the tendon as the tendon is inserted through the cylindrical extension and the anchor base aperture, and a cap for sealing the tendon within the anchor base aperture.

DESCRIPTION OF THE PREFERRED EMBODIMENTS

The invention provides a unique system for providing a post tension system resistant to corrosion. Each tendon typically comprises an exterior sheath surrounding at least two strands formed with a material such as carbon steel.

Figure 1:
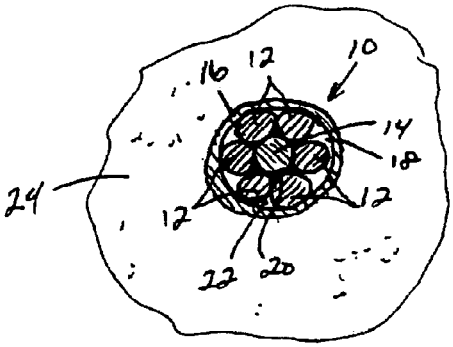
FIG. 1 illustrates a mono-strand cable enclosed with a first sheath.

FIG. 1 illustrates a sectional view wherein a mono-strand wire tendon 10, formed with individual wire strands 12 about center wire 14, is positioned within first sheath 16. One or more wire strands 12 are helically wrapped about center wire strand 14 and form helical grooves on the exterior surface of cable 10. Such helical grooves are cumulatively identified as shaped annulus 18 defining the space between tendon 10 and the interior cylindrical surface of first sheath 16.

Because wire strands 12 are circular in cross-section, spaces between adjacent wire strands 12 and center wire 14 are cumulatively identified as cable interior interstices 20. As shown in FIG. 1, annulus 18 and interstices 20 are filled with corrosion resistant material 22. Grease or another suitable material can be used for corrosion resistant material 22 to eliminate air pockets and to resist water intrusion into contact with wire strands 22. By filling annulus 18 with a lubricant or corrosion resistant material 22, the interior surface of first sheath 16 can be substantially cylindrical in one embodiment of the invention.

Figure 2:
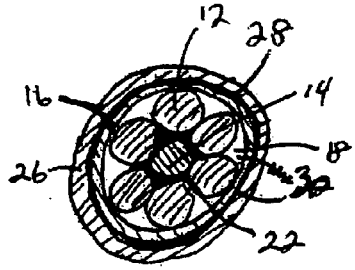
FIG. 2 illustrates a second sheath around the first sheath.
Figure 3:
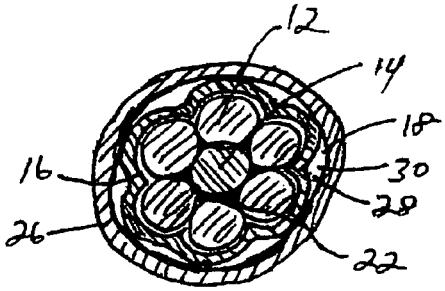
FIG. 3 illustrates a first sheath closely formed to the cable exterior surface.

FIGS. 2 and 3 illustrate second sheath 26 formed about first sheath 16. Annulus 28 is formed between second sheath 26 and first sheath 16 and is filled with a lubricant 30 to facilitate sliding movement therebetween. Lubricant 30 can comprise a corrosion resistant material similar to material 22. Grease or another lubricant is place on the outer surface of the seven strand wire tendon adjacent to the elastromeric sheath to resist corrosion created by air and water infiltration between the tendon and the sheath. In FIG. 2 annulus 28 is substantially cylindrical. In FIG. 3 first sheath 16 is tightly formed about the exterior surface of tendon 10 and helical grooves, filled with corrosion resistant material, are formed in the exterior surface of the first sheath 16. This feature preferably uses a material for first sheath 16 having a thickness less than then ten mils. Conventional membranes are typically twenty-five mils thick for regular systems and forty mils thick for high corrosion resistant, encapsulated systems. By providing a slim first sheath 16 about tendon 10 to create grooves in the exterior surface of first sheath 16, corrosion resistant material 30 can be stored in annulus 28 to resist intrusion by water of other contamination into contact with first sheath 16 or tendon 10.

Figure 4:
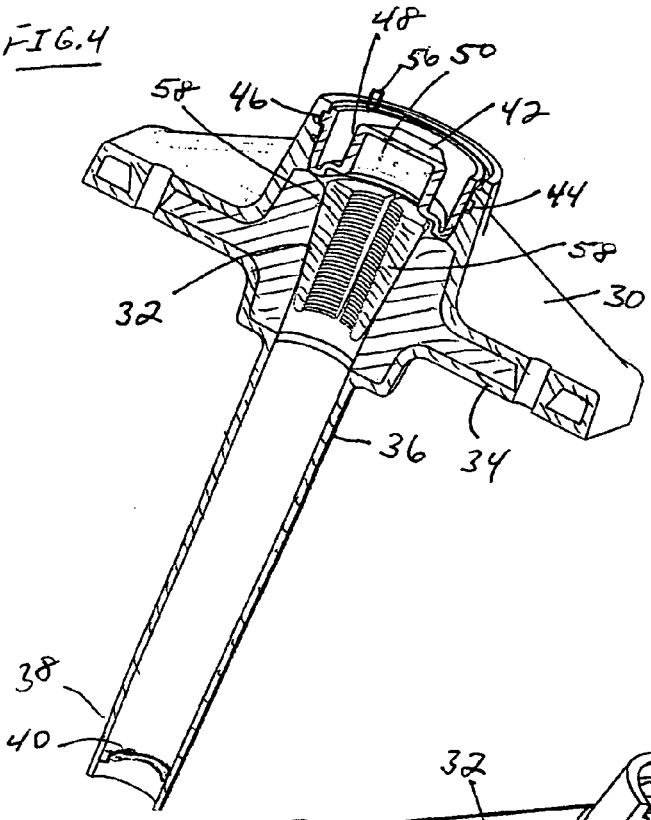
FIG. 4 illustrates a sectional view of an anchor base.

FIG. 4 illustrates post-tension anchor comprising base 30 having shaped aperture 32. Base 30 is formed with a cast metal material suitable for handling large compressive loads. Sheath 34 can be attached to base 30 in one embodiment of the invention and includes cylindrical extension 36 having a contact end 38 distal from base 30. Contact end 38 is preferably at least four inches distal from base 32, however shorter or longer lengths are possible within the usable scope of the invention. The inner surface of contact end 38 is preferably circular in cross-section for contacting the exterior surface of tendon 10 as tendon 10 is inserted through cylindrical extension 36 and base aperture 32. Seal 40 can be positioned between contact end 38 and tendon 10 to restrict liquid intrusion into the inside of the cylindrical extension 36.

Cap 42 has threads 44 engaged with threadform 46 on sheath 34. Cap 42 includes shaped end 48 configured to facilitate rotatable engagement and disengagement of cap 42 relative to sheath 34. As illustrated, shaped end 48 can be a polygonal configuration such as a hexagonal or other shaped form suitable for engagement with a socket wrench. In other embodiments of the invention shaped end can be configured to be engagable with different drive mechanisms such as screwdrivers, wrenches, pliers and other devices. Grease 50 can be positioned within cap 42 to seal the end of tendon 10 placed therein.

Figure 6:
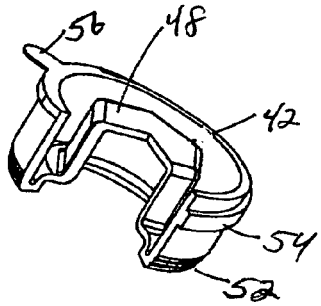
FIG. 6 illustrates a ring cap for sealing the interior of an anchor base.
Figure 5:
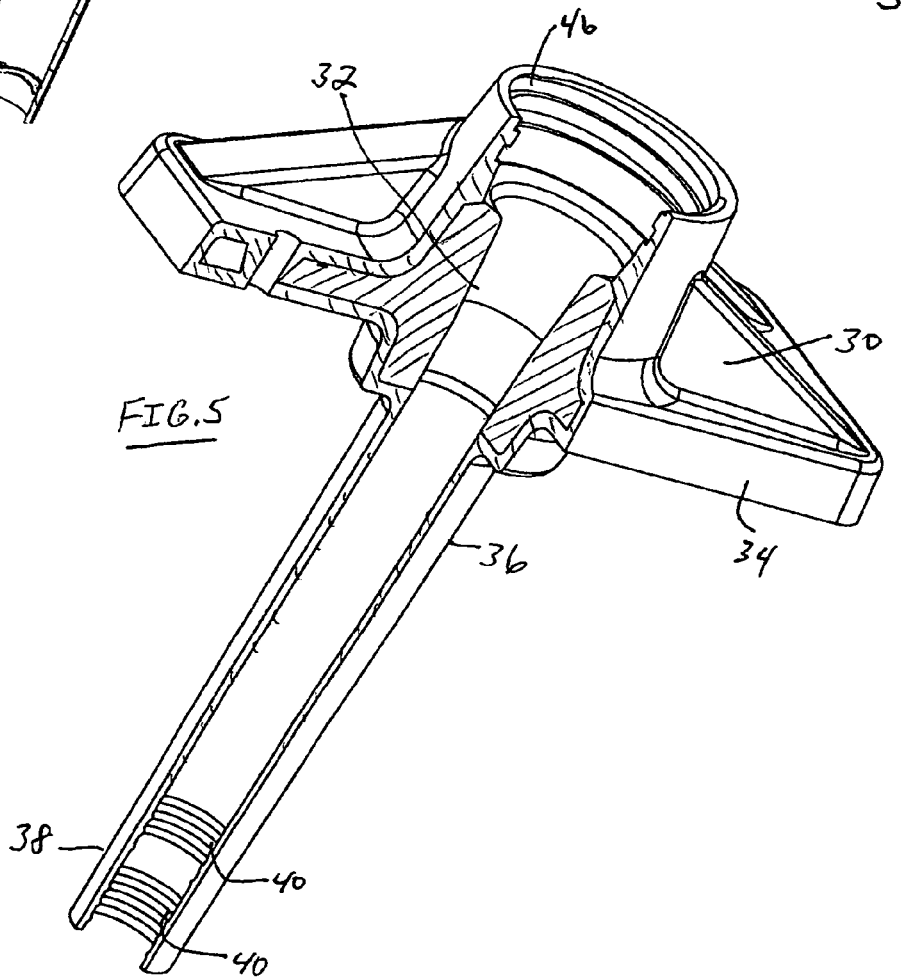
FIG. 5 illustrates detail of a cap having different thread combinations

In one embodiment of the invention threads 44 can include a double start lead to facilitate attachment of cap 42 to sheath 34. The double start lead can comprise threads having different sizes and pitches to provide different make-up characteristics. FIG. 5 illustrates cap 42 and base 30 in expanded position and displays cap 42 having different threadforms 52 and 54 for selective engagement with correlating threadforms on sheath 34. As shown in FIG. 6, cap 42 can also have indicator tab 56 which flares upwardly when cap 42 is fully engaged with base 30. Such feature provides a visual indication of full engagement and an effective watertight seal between cap 42 and base 30. As also can be seen in FIG. 5, the extension 36, having seal 40 therein at the distal end 38 is formed integrally with the sheath 34.

FIG. 4 illustrates the installation of wedges 58 in contact with tendon 10 and base 30. Wedges 58 are installed into such position after cap 42 has been removed from engagement with sheath 34 and base 30. The invention permits wedges 58 to be installed directly against first sheath 16 or second sheath 26 of cable 10 so that wedges 58 contact wire strands 12 with minimal disruption to sheaths 16 or 26. This feature of the invention reduces the amount of wire strands 12 requiring field repair and sealant and significantly reduces installation time and possibility of corrosion base upon failure of such field repairs. Because cap 42 is reusable, cap 42 can be reinstalled with base 30 to seal the interior of base 30. Alternatively, another structure such as ring cap 60 can be positioned over tendon 10 to seal the interior of base 30 as shown in FIG. 6.

Figure 8:
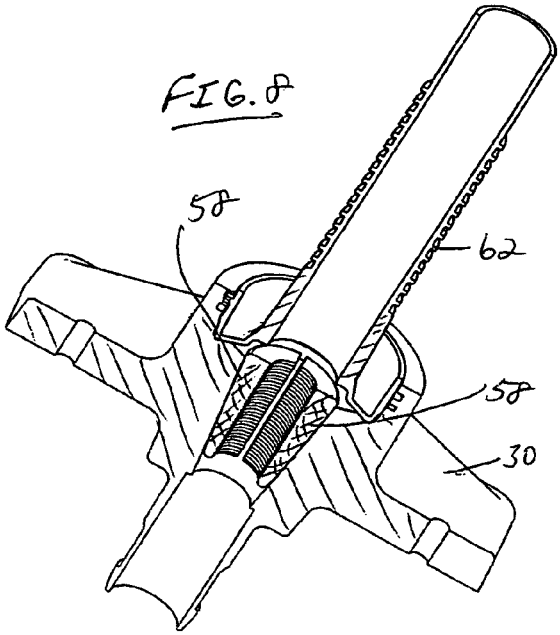
FIG. 8 illustrates a cap extension engaged with an anchor base.
Figure 7:
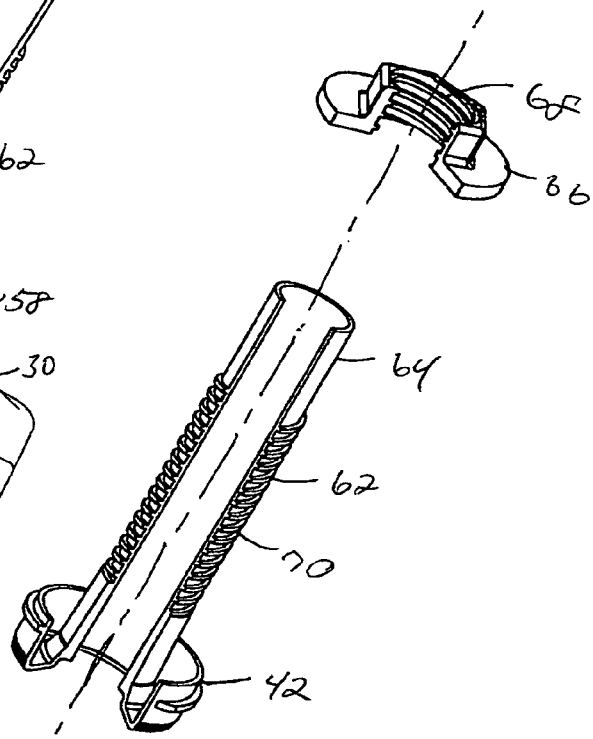
FIG. 7 illustrates a cap extension attached to a cap.

FIG. 7 illustrates in exploded detail cap extension 62 integrated within cap 42. Cap extension 62 can also comprise a separate component attached to cap 42 with snap connections, tape, threadforms, or other techniques. Cap extension 62 provides the function of extending the useful length of cap 42, thereby permitting a longer length of tendon (not shown) to extend beyond wedges 58 within base 30 as illustrated in FIG. 8. Extension end 64 can be open as illustrated to permit the passage of tendon 10 therethrough or can be closed. Lock nut 66 having threadform 68 can be engaged with threadform 70 on cap extension 62 to retail a pocketformer or other apparatus or to provide a closure for the open end of extension end 64.

Figure 10:
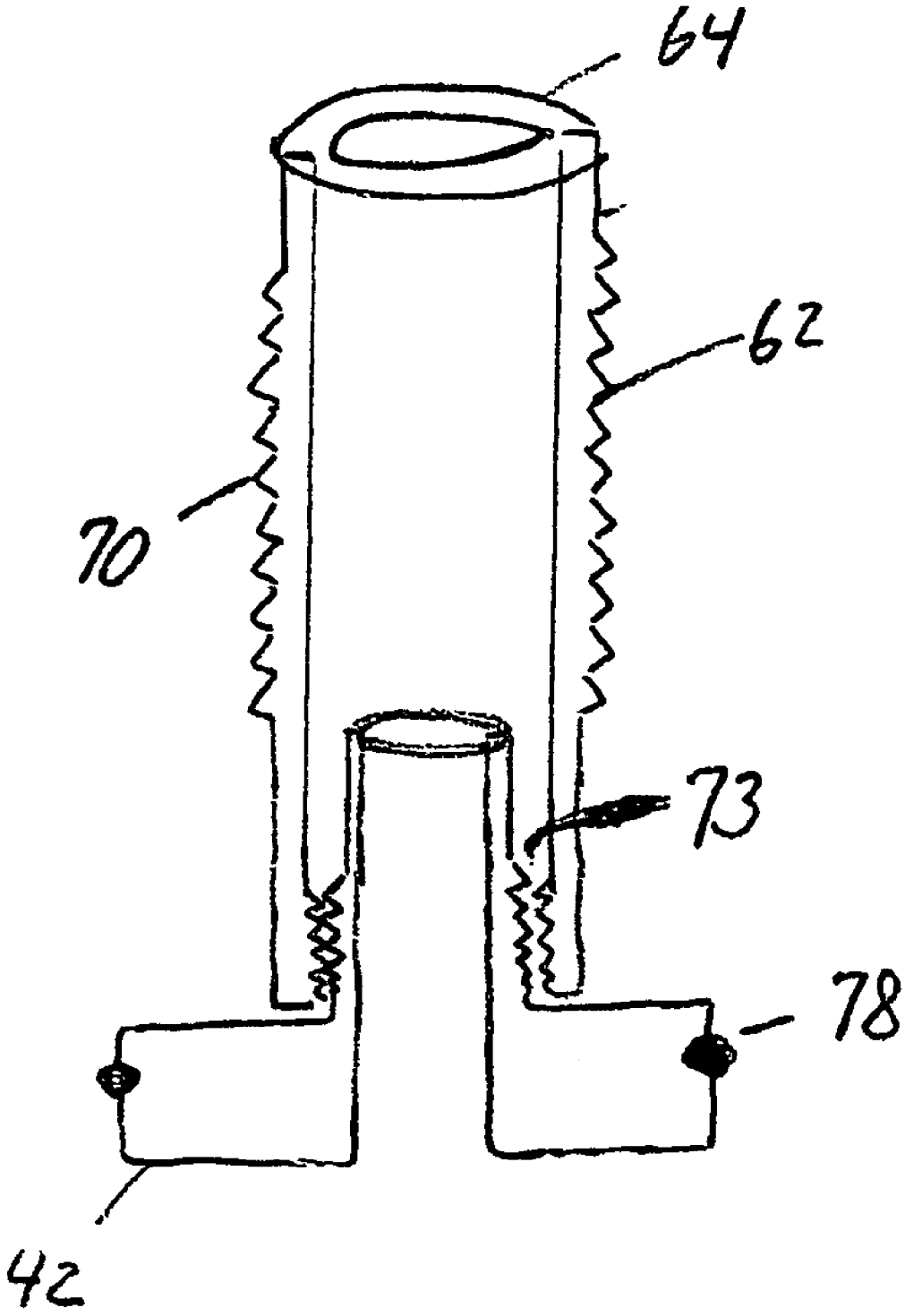
FIG. 10 shows one embodiment of a cap having a removably engaged cap extension.

An example of a cap extension 62 is shown in FIG. 10 as a separate element coupled to the cap by means of threads 73 such that the extension may be selectively engaged with the cap 42.

Figure 9:
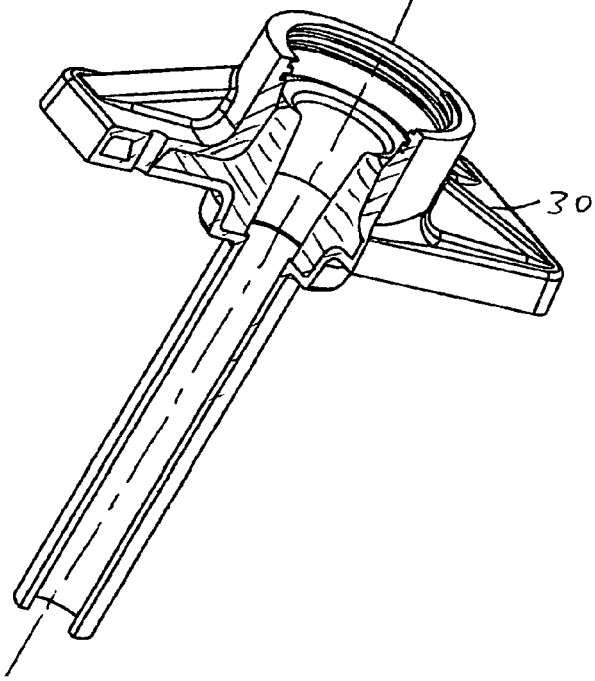
FIG. 9 illustrates one embodiment of a cap extension.
Figure 9:
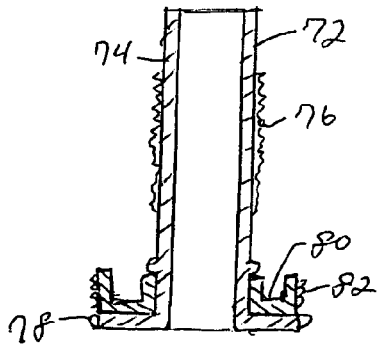

FIG. 9 illustrates another embodiment of cap extension 72 wherein extension tube 74 has threadform 76 and seal 78. Lock ring 80 has threadform 82 for engagement with base 30 and for retaining extension tube 74 in a fixed position relative to base 30. The combination of lock ring 80 and extension tube 74 significantly facilitates manufacture of extension 72.

The invention provides superior anti-corrosion protection through the entire tendon length and especially near the point of engagement with post-tension anchors. The sheath materials for tendon 10 can be selected from material classes such as nylon, polymers, metals, or other organic or inorganic or mineral or synthetic materials. An outer second sheath can be formed with a tough material resistant to punctures and stretching damage, while an interior first sheath can be formed with another material for retaining the corrosion resistant material.

The configuration of base 30 permits installation and tensioning of tendon 10 without removal of sheath 16 from tendon 10 at the location of base 30. By avoiding the disturbance of the manufactured sheath 16, the most sensitive point of corrosion is completely eliminated. The configuration of the caps and pocket formers described in cooperation with base 30 significantly reduces labor time and cost and provides superior reliability during installation. Such reliability reduces field damage to post tension components and the possibility of corrosion resulting from such damage, and eliminates the need for costly and unreliable field repairs.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention

What is claimed is:

1. An anchor for engagement with a post-tension tendon, comprising:

an anchor base having a generally tapered wedge receiving bore;

a sheath surrounding the anchor base, the sheath having a substantially cylindrical extension on one side of the anchor base for contacting the tendon at a distal end thereof from the anchor base, the extension formed integrally with the sheath and having a seal disposed therein proximate the distal end; and a cap having external threads thereon for engaging corresponding internal mating threads on the sheath on a side of the anchor base opposite to the sheath extension, the cap having a tool engagement surface thereon to facilitate rotation by a tool for engagement with the sheath, the cap having an indicator tab on an external surface thereof, the tab positioned to be deflected upon full engagement of the cap with the anchor base.

2. The anchor of claim 1 wherein the cap includes a cap extension coupled thereto and having external threads thereon formed for engagement with corresponding threads on a pocketformer.

3. The anchor of claim 2 further comprising a locknut for threaded engagement with the external threads on the cap extension, the locknut for retaining the pocketformer on the thread extension.

4. The anchor of claim 2 wherein the cap extension is selectively engageable with the cap.

5. The anchor of claim 1 wherein the external threads on the cap and the corresponding threads on the sheath comprise a double start lead to facilitate attachment of the cap to the sheath.

6. An anchor for engagement with a post-tension tendon, comprising:

an anchor base having a generally tapered wedge receiving bore;

a sheath surrounding the anchor base, the sheath having a substantially cylindrical extension on one side of the anchor base for contacting the tendon at a distal end thereof from the anchor base, the extension formed integrally with the sheath and having a seal disposed therein proximate the distal end;

a cap having external threads thereon for engaging corresponding internal mating threads on the sheath on a side of the anchor base opposite to the sheath extension, the cap having a tool engagement surface thereon to facilitate rotation by a tool for engagement with the sheath, the external threads on the cap and the corresponding threads on the sheath comprise a double start lead to facilitate attachment of the cap to the sheath.

7. The anchor of claim 6 wherein the cap includes a cap extension coupled thereto and having external threads thereon formed for engagement with corresponding threads on a pocketformer.

8. The anchor of claim 7 further comprising a locknut for threaded engagement with the external threads on the cap extension, the locknut for retaining the pocketformer on the thread extension.

9. The anchor of claim 7 wherein the cap extension is selectively engageable with the cap.

10. The anchor of claim 6 wherein the cap includes an indicator tab on an external surface thereof, the tab positioned to be deflected upon full engagement of the cap with the anchor base.

11. An anchor for engagement with a post-tension tendon, comprising:

an anchor base having a generally tapered wedge receiving bore;

a sheath surrounding the anchor base, the sheath having a substantially cylindrical extension on one side of the anchor base for contacting the tendon at a distal end thereof from the anchor base, the extension formed integrally with the sheath and having a seal disposed therein proximate the distal end; and a cap having external threads thereon for engaging corresponding internal mating threads on the sheath on a side of the anchor base opposite to the sheath extension, the cap having a tool engagement surface thereon to facilitate rotation by a tool for engagement with the sheath, the cap including a cap extension coupled thereto and having external threads thereon formed for engagement with corresponding threads on a pocketformer, the cap extension selectively engageable with the cap.

12. The anchor of claim 11 further comprising a locknut for threaded engagement with the external threads on the cap extension, the locknut for retaining the pocketformer on the thread extension.

13. The anchor of claim 11 wherein the external threads on the cap and the corresponding threads on the sheath comprise a double start lead to facilitate attachment of the cap to the sheath.

14. The anchor of claim 11 wherein the cap includes an indicator tab on an external surface thereof, the tab positioned to be deflected upon full engagement of the cap with the anchor base.

* * * * *